US011224788B2

(12) United States Patent
Chauvin et al.

(10) Patent No.: US 11,224,788 B2
(45) Date of Patent: Jan. 18, 2022

(54) VIBRATION-DAMPING END CAPS FOR BALL BATS

(71) Applicant: EASTON DIAMOND SPORTS, LLC, Thousand Oaks, CA (US)

(72) Inventors: Dewey Chauvin, Simi Valley, CA (US); Linda Hunt, Simi Valley, CA (US); Ian Montgomery, Simi Valley, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 0 days.

(21) Appl. No.: 16/667,818

(22) Filed: Oct. 29, 2019

(65) Prior Publication Data

US 2021/0121754 A1 Apr. 29, 2021

(51) Int. Cl.

| | |
|---|---|
| ***A63B 60/54*** | (2015.01) |
| ***A63B 59/56*** | (2015.01) |
| ***A63B 102/18*** | (2015.01) |

(52) U.S. Cl.

CPC ..... *A63B 60/54* (2015.10); *A63B 59/56* (2015.10); *A63B 2102/18* (2015.10)

(58) Field of Classification Search

CPC ..... A63B 59/50; A63B 59/51; A63B 59/52; A63B 59/54; A63B 59/56; A63B 60/54; A63B 2102/18

USPC ..... 446/564, 566, 567; 473/564, 566, 567

See application file for complete search history.

(56) References Cited

U.S. PATENT DOCUMENTS

| | | | |
|---|---|---|---|
| 1,026,990 | A | 5/1912 | Matson |
| 1,030,982 | A | 7/1912 | Dinger |
| 1,499,128 | A | 6/1924 | Shroyer |
| 1,603,904 | A | 10/1926 | Cohn |
| 2,099,521 | A | 11/1937 | Herkimer |
| 3,116,926 | A | 1/1964 | Owen |
| 3,392,976 | A | 7/1968 | Hayes |
| 3,508,748 | A | 4/1970 | Strimel |
| 3,521,883 | A | 7/1970 | Hamilton |
| 3,578,801 | A | 5/1971 | Piazza |

(Continued)

FOREIGN PATENT DOCUMENTS

WO 2012115813 A1 8/2012

OTHER PUBLICATIONS

Adair, Robert K., "The Physics of Baseball," Perennial; 2002, p. 80.

(Continued)

*Primary Examiner* — Joseph B Baldori

(74) *Attorney, Agent, or Firm* — Perkins Coie LLP

(57) ABSTRACT

An end-cap assembly is configured to be attached to a distal end of a barrel of a ball bat. In some embodiments, the end-cap assembly includes a sprung-mass portion, a base portion, and one or more flexible members connecting the sprung-mass portion to the base portion. The sprung-mass portion is movable relative to the base portion along one or more directions, such as one or more directions transverse to the longitudinal axis of the ball bat. A ball bat may include a handle, a barrel attached to the handle, and an end-cap assembly attached to the barrel. The end-cap assembly may include a sprung-mass portion, a base portion, and one or more flexible members connecting the sprung-mass portion to the base portion to allow the sprung-mass portion to move relative to the distal end of the ball bat.

6 Claims, 10 Drawing Sheets

(56) References Cited

U.S. PATENT DOCUMENTS 3,703,290 A 11/1972 Wilson
3,727,295 A 4/1973 Gildemeister
3,801,098 A 4/1974 Gildemeister
3,830,496 A 8/1974 Reizer
3,834,697 A 9/1974 Mcnamara
3,861,682 A 1/1975 Fujii
3,876,204 A 4/1975 Moore
3,941,380 A 3/1976 Lacoste
4,038,719 A 8/1977 Bennett
4,200,285 A 4/1980 Petitti
4,248,425 A 2/1981 Easton
4,260,150 A 4/1981 Tabet
4,505,479 A 3/1985 Souders
4,541,631 A 9/1985 Sasse
4,609,198 A 9/1986 Tarr
4,627,635 A 12/1986 Koleda
4,690,405 A 9/1987 Frolow
4,811,947 A 3/1989 Takatsuka
4,819,935 A 4/1989 Dirksing
4,826,167 A 5/1989 Lo
4,875,679 A 10/1989 Movilliat
4,909,509 A 3/1990 Boschian
4,948,131 A 8/1990 Nakanishi
4,951,948 A 8/1990 Peng
5,039,096 A 8/1991 Chen
5,092,594 A 3/1992 Jang
5,104,123 A 4/1992 Okitsu
5,131,652 A 7/1992 Peng
5,141,228 A 8/1992 Soong
5,180,163 A 1/1993 Lanctot
5,219,164 A 6/1993 Peng
5,236,198 A 8/1993 Haines
5,242,724 A 9/1993 You
5,277,421 A 1/1994 Rewolinski
5,282,618 A 2/1994 Hong
5,303,917 A 4/1994 Uke
5,314,180 A 5/1994 Yamagishi
5,322,280 A 6/1994 Wu
5,362,046 A 11/1994 Sims
5,380,003 A 1/1995 Lanctot
5,421,572 A * 6/1995 MacKay, Jr. ..... A63B 59/51 473/566
5,465,967 A 11/1995 Boeckenhaupt
5,494,280 A 2/1996 Mackay
5,511,777 A 4/1996 Mcneely
5,593,158 A 1/1997 Filice
5,624,114 A 4/1997 Kelsey
5,655,980 A 8/1997 Nashif
5,692,971 A 12/1997 Williams
5,722,908 A 3/1998 Feeney
5,759,113 A 6/1998 Lai
5,772,541 A 6/1998 Buiatti
5,785,614 A 7/1998 Mackay
5,785,617 A 7/1998 Mackay
5,842,933 A * 12/1998 Lewis ..... A63B 49/08 473/300
5,931,750 A 8/1999 Mackay
5,937,843 A 8/1999 Troncoso
5,944,617 A 8/1999 Falone
5,954,602 A * 9/1999 Eggiman ..... A63B 49/08 473/566
5,964,672 A 10/1999 Bianchi
5,980,937 A 11/1999 Tournier
6,007,439 A 12/1999 Mackay
6,007,440 A 12/1999 Bender
6,022,281 A 2/2000 Nolan
6,024,657 A 2/2000 Bettencourt
6,042,485 A 3/2000 Cheng
6,053,827 A 4/2000 Mackay
6,056,655 A 5/2000 Feeney
6,077,178 A 6/2000 Brandt
6,117,028 A 9/2000 You
6,176,795 B1 1/2001 Schullstrom
6,234,922 B1 5/2001 White
6,254,498 B1 7/2001 Tyner
6,254,502 B1 7/2001 Becker
6,257,220 B1 7/2001 Mcpherson
6,280,353 B1 8/2001 Brundage
6,344,007 B1 2/2002 Feeney
6,386,999 B2 5/2002 White
6,461,259 B1 10/2002 Li
6,530,852 B2 3/2003 Rios
6,540,627 B1 4/2003 Leal
6,569,042 B2 5/2003 Lachance
6,702,698 B2 3/2004 Eggiman
6,709,352 B1 3/2004 Albin
6,729,983 B1 5/2004 Vakili
6,743,127 B2 6/2004 Eggiman
6,767,297 B2 7/2004 Hebreo
6,821,218 B2 11/2004 Byrne
6,863,628 B1 3/2005 Brandt
6,872,157 B2 3/2005 Falone
6,875,137 B2 4/2005 Forsythe
6,905,429 B2 6/2005 Forsythe
6,945,886 B2 9/2005 Eggiman
6,969,330 B1 11/2005 Meeker
6,974,396 B2 12/2005 Mauer
6,994,641 B2 2/2006 Hebreo
7,014,580 B2 3/2006 Forsythe
7,033,291 B1 4/2006 Meeker
7,044,871 B2 5/2006 Sutherland
7,056,240 B2 6/2006 Brock
7,097,578 B2 8/2006 Guenther
7,232,387 B1 6/2007 Heald
7,264,098 B2 * 9/2007 McPherson ..... A63B 60/54 188/379
7,320,653 B2 1/2008 Fitzgerald
7,361,107 B2 4/2008 Giannetti
7,377,866 B2 5/2008 Nguyen
7,410,433 B2 8/2008 Guenther
7,442,134 B2 10/2008 Giannetti
7,442,135 B2 10/2008 Giannetti
7,527,570 B2 5/2009 Giannetti
7,572,197 B2 8/2009 Chauvin
7,749,114 B2 7/2010 Thouin
7,794,340 B2 9/2010 Mauer
7,896,763 B2 3/2011 Giannetti
7,906,191 B2 3/2011 Pratt
7,985,149 B2 7/2011 Watari
8,075,418 B2 12/2011 Jahangiri
8,226,505 B2 7/2012 Burger
8,371,154 B2 2/2013 Brandt
8,425,353 B2 4/2013 Jones
8,512,174 B2 8/2013 Epling
8,512,175 B2 8/2013 Epling
8,632,428 B2 1/2014 Burger
8,715,118 B2 5/2014 Epling
8,795,108 B2 8/2014 Chauvin
8,852,032 B1 10/2014 Barnes
8,992,352 B1 3/2015 Lindsay
9,101,810 B2 8/2015 Carlson
9,186,562 B1 11/2015 Mathur
9,242,156 B2 1/2016 Goodwin
9,427,640 B2 8/2016 Davis
9,457,247 B2 10/2016 Fitzgerald
9,511,267 B2 12/2016 Thurman
10,745,076 B2 * 8/2020 Walker ..... F16F 1/376
2001/0034276 A1 10/2001 Brown
2002/0094888 A1 7/2002 Lachance
2003/0232671 A1 * 12/2003 Hebreo ..... A63B 60/08 473/564
2004/0038758 A1 2/2004 Guenther
2004/0248676 A1 12/2004 Taylor
2005/0096159 A1 5/2005 Houston
2006/0025246 A1 2/2006 Forney
2007/0254751 A1 11/2007 Wilson
2007/0281806 A1 12/2007 Chung
2008/0009363 A1 1/2008 Solodovnick
2008/0280738 A1 11/2008 Brennan
2009/0131194 A1 5/2009 Keough
2009/0253539 A1 10/2009 Lovine
2010/0267523 A1 10/2010 Wilkinson
2011/0143870 A1 6/2011 Schulte
2012/0214622 A1 8/2012 Rockhill

(56) References Cited

U.S. PATENT DOCUMENTS

| | | | | |
|---|---|---|---|---|
| 2013/0196769 | A1 | 8/2013 | Shocklee | |
| 2013/0196795 | A1 | 8/2013 | Shocklee | |
| 2014/0274493 | A1 | 9/2014 | Heussner | |
| 2015/0157909 | A1* | 6/2015 | Van Nguyen ..... | A63B 59/50<br>473/568 |
| 2015/0196816 | A1* | 7/2015 | Davis ..... | A63B 60/16<br>473/566 |
| 2016/0089586 | A1 | 3/2016 | Sawyer | |
| 2017/0100650 | A1 | 4/2017 | Anderle | |
| 2018/0361215 | A1* | 12/2018 | Van Nguyen ..... | A63B 60/54 |

OTHER PUBLICATIONS

ASTM F1881, Standard Test Methods for Measuring Baseball Bat Performance Factor, Jun. 2009.
ASTM F1890, Standard Test Methods for Measuring Softball Bat Performance Factor, Jan. 2018.
ASTM F2219, Standard Test Methods for Measuring High-Speed Bat Performance, Jun. 2014.
Demarini, Vizion Limited Edition Adjustable Slowpitch Bat, 2015.
Russell, Daniel A., "Physics of Baseball & Softball Bats—Forces Between Bat and Ball," Penn State University College of Engineering, Graduate Program in Acoustics, available at https://www.acs.psu.edu/drussell/bats/impulse.html, originally posted Jan. 10, 2002, web page visited Oct. 29, 2019.
Watts, Robert G., Bahill, A. Terry; "Keep Your Eye on the Ball," W.H. Freeman and Company; 1990; p. 86.

* cited by examiner

VIBRATION-DAMPING END CAPS FOR BALL BATS

BACKGROUND

When a ball bat (such as a baseball or softball bat) collides with a ball, the impact causes vibration in the bat that batters may experience as a painful sting in their hands. Vibration may be more severe when the ball impacts the bat away from a center of percussion in the barrel (sometimes referred to as the "sweet spot"). If the vibration is especially severe, it may injure a batter. To reduce the vibration transferred to a batter's hands (in turn, to reduce the "sting"), batters may wear padded gloves or use a thick cushioned grip on the bat handle. But some padded gloves and thick grips reduce tactile gnosis, and a thick grip may add unnecessary weight to a ball bat. It is desirable to dampen vibrations in a ball bat without reducing tactile gnosis and without adding unnecessary weight.

SUMMARY

Representative embodiments of the present technology include an end-cap assembly configured to be attached to a distal end of a barrel of a ball bat. In some embodiments, the end-cap assembly includes a sprung-mass portion, a base portion, and one or more flexible members connecting the sprung-mass portion to the base portion. The sprung-mass portion is movable relative to the base portion along one or more directions, such as one or more directions transverse to the longitudinal axis of the ball bat or along the longitudinal axis of the bat. In some embodiments, the base portion is configured to be attached to the distal end of the barrel.

In some embodiments, a ball bat may include a handle with a knob, a barrel attached to the handle, and an end-cap assembly attached to the barrel, the end-cap assembly including a sprung-mass portion, a base portion, and one or more flexible members connecting the sprung-mass portion to the base portion to allow the sprung-mass portion to move relative to the distal end of the ball bat or the base portion.

In some embodiments, the sprung-mass portion and the base portion are connected to each other by only the one or more flexible members. In some embodiments, the one or more flexible members include a partial or complete ring of flexible material positioned around the sprung-mass portion and between the sprung-mass portion and the base portion. In some embodiments, the one or more flexible members include a plurality of ribs extending radially inwardly from the base portion. In some embodiments, the one or more flexible members may extend longitudinally between the base portion and the sprung-mass portion. In some embodiments, the sprung-mass portion includes a hub, and the one or more flexible members includes a plurality of serpentine ribs extending between the hub and the base portion. In some embodiments, the sprung-mass portion is spaced apart from the base portion along the longitudinal axis of the bat to form a gap between the sprung-mass portion and the base portion.

In some embodiments, an end-cap assembly includes a sprung-mass portion and one or more flexible members extending from the sprung-mass portion to connect the end-cap assembly to the barrel of a ball bat. The one or more flexible members may enable movement of the sprung-mass portion relative to the barrel of the ball bat.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views.

DETAILED DESCRIPTION

The present technology is directed to vibration-damping end caps for ball bats, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to ball bats, may not be shown or described in detail so as to avoid unnecessarily obscuring the relevant description of the various embodiments. Accordingly, embodiments of the present technology may include additional elements or exclude some of the elements described below with reference to FIGS. 1-7C, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all the items in the list, or (c) any combination of items in the list. Further, unless otherwise specified, terms such as "attached" or "connected" are intended to include integral connections, as well as connections between physically separate components.

Figure 1:
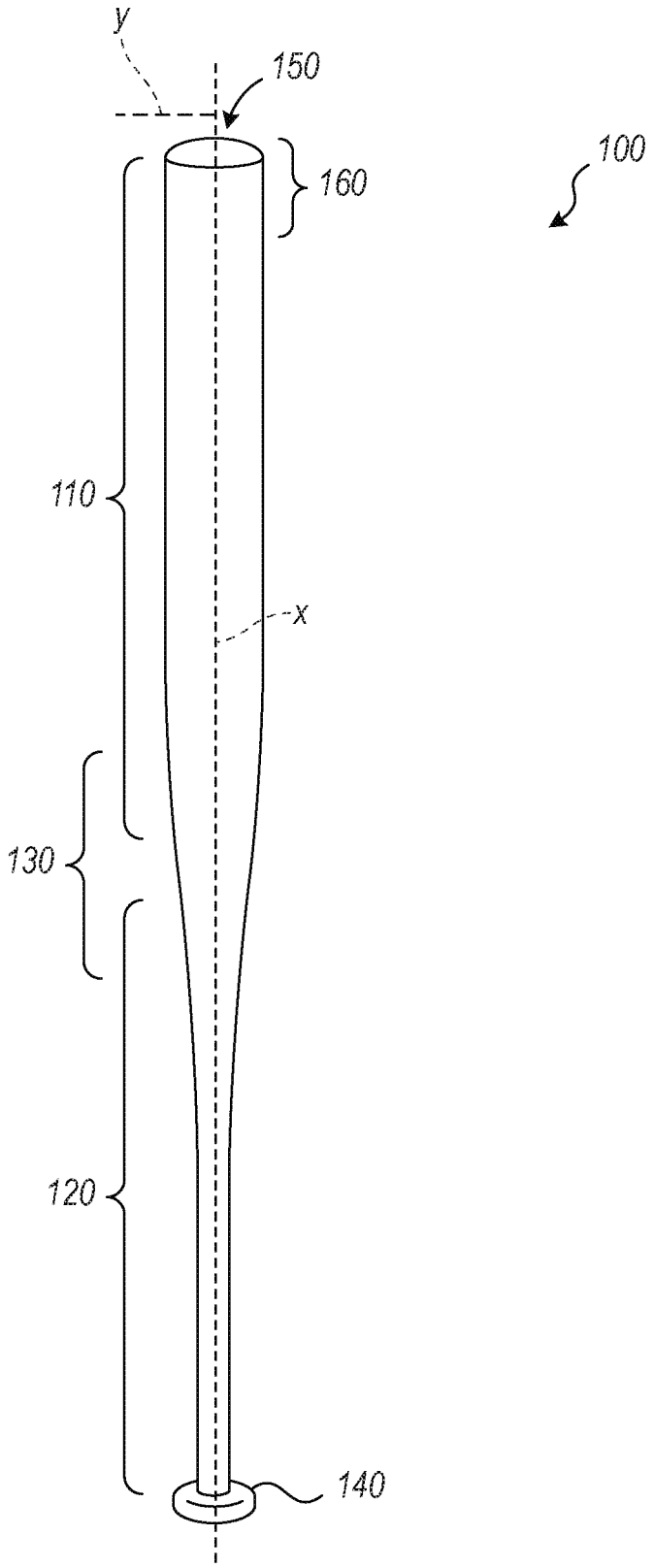
FIG. 1 illustrates a ball bat that may include an end-cap assembly according to embodiments of the present technology.

FIG. 1 illustrates a ball bat 100 extending along a longitudinal axis x and having a barrel 110 attached to a handle 120. A radial axis y is also illustrated and is understood to be any radial direction perpendicular to the x-axis. There may be a transitional or taper region 130 in which the larger diameter of the barrel 110 transitions to the narrower diameter of the handle 120. The handle 120 may include a knob 140, while an end-cap assembly 150 may be retained on or within the bat 100 at a distal end 160 opposite the knob 140 and the handle 120. The end-cap assembly 150 may be attached to the distal end 160, for example, and it may also generally cover the distal end 160 or close off an open end of the barrel 110 at the distal end 160.

The bat 100 may have any suitable dimensions. The bat 100 may have an overall length of 20 to 40 inches, or 26 to 34 inches. The overall barrel diameter may be 2.0 to 3.0 inches, or 2.25 to 2.75 inches. For example, typical ball bats may have diameters of 2.25, 2.625, or 2.75 inches. Bats having various combinations of these overall lengths and barrel diameters, or any other suitable dimensions, are contemplated herein. Bats suitable for use in baseball or softball or other similar activities are contemplated herein. The specific preferred combination of bat dimensions is generally dictated by the user of the bat 100, and may vary greatly between users.

Figure 2A:
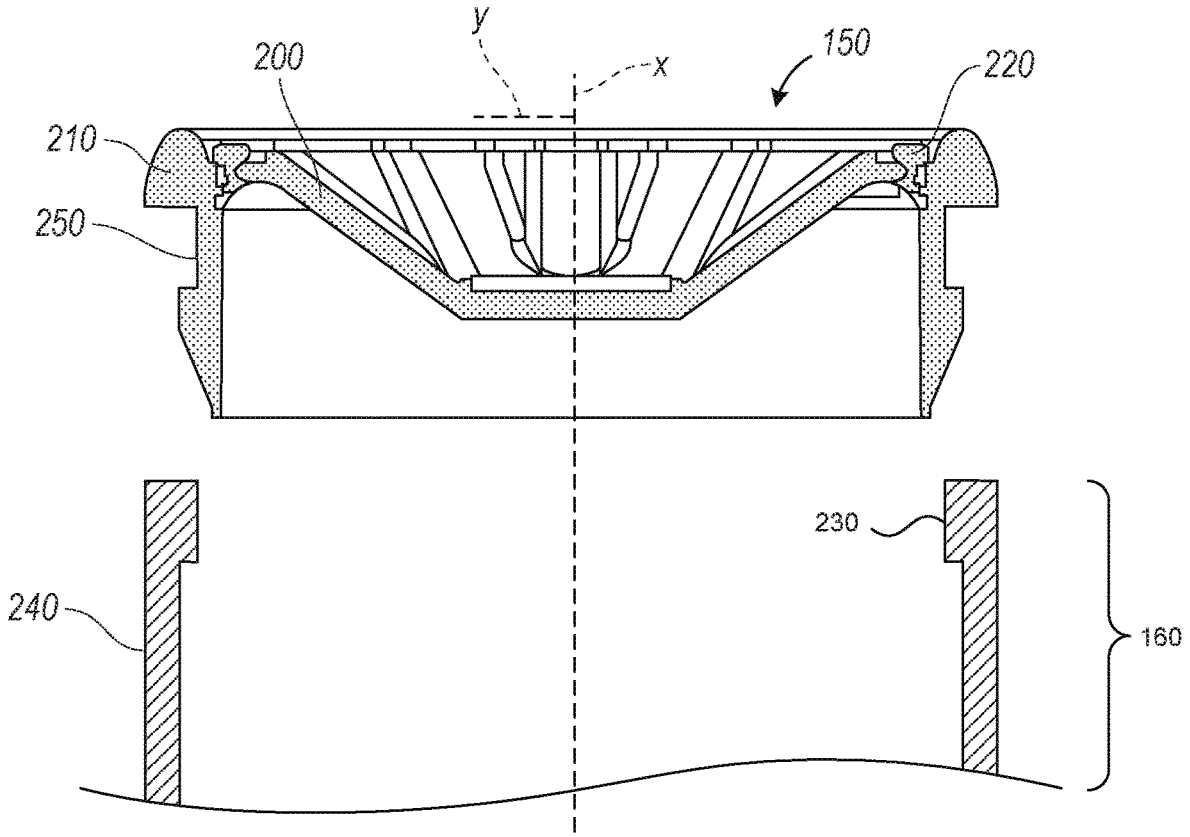
FIGS. 2A and 2B illustrate cross-sectional views of a distal end of a ball bat and an end-cap assembly configured in accordance with embodiments of the present technology.
Figure 2B:
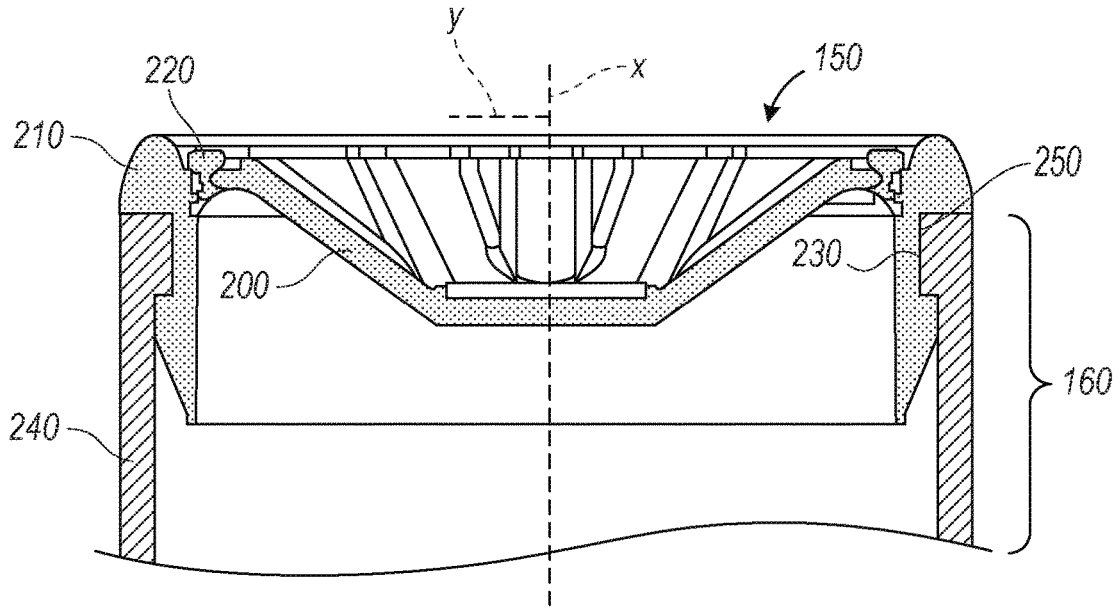

FIGS. 2A and 2B illustrate cross-sectional views of the distal end 160 of the ball bat and an end-cap assembly 150 configured in accordance with embodiments of the present technology. FIG. 2A is an exploded view illustrating the end-cap assembly 150 and the distal end 160 of a ball bat. FIG. 2B is an assembled view illustrating the end-cap assembly 150 attached to the distal end 160 of the ball bat. As will be described in additional detail below, end-cap assemblies configured in accordance with embodiments of the present technology include a sprung-mass mechanism that suspends all or part of the mass of the end-cap assembly on or in the distal end 160 of the ball bat. For example, an end-cap assembly 150 may include a sprung-mass portion 200 connected to a base portion 210 via a flexible member 220 (or one or more flexible members 220, in accordance with embodiments of the present technology). The one or more flexible members may also provide a force or forces that tend to bias the sprung-mass portion to be centered (such as concentric) with the base portion.

The base portion 210 (or the end-cap assembly 150 as a whole) may be molded, bonded, pressed, or otherwise locked in the distal end 160 of the bat such that it stays attached to the bat during use. In one embodiment, a ridge or lip 230 protruding inwardly and extending around all or part of the wall 240 of the bat engages a corresponding groove or recess 250 circumscribing the base portion 210 of the end-cap assembly 150. The base portion 210 functions as a retention ring to hold the remainder of the end-cap assembly 150 in or on the distal end 160 of the bat. Although specific connections between end-cap assemblies or base portions and distal ends of ball bats are illustrated and described herein, any suitable connection may be used to restrain the end-cap assemblies or base portions to the distal end of a ball bat.

The base portion 210 supports and suspends the sprung-mass portion 200 via the flexible member 220. In some embodiments, the sprung-mass portion 200 may have any suitable shape, for example, a cone, a disk, or any other configuration having mass. In some embodiments, the sprung-mass portion 200 is concentrically positioned within the base portion 210, separated from the base portion 210 by the flexible member 220. In some embodiments, the flexible member 220 includes a partial or complete ring of flexible material (such as an elastomeric material) around the sprung-mass portion 200. The flexible member 220 may include any material or shape suitable for movably suspending the sprung-mass portion 200 relative to the base portion 210. In other words, in various embodiments of the present technology, a sprung-mass portion, such as the sprung-mass portion 200 shown in FIGS. 2A and 2B, may be movable relative to a base portion, such as the base portion 210 shown in FIGS. 2A and 2B, via a flexible member 220 (or one or more flexible members).

Upon impact with a ball, the sprung-mass portion of an end-cap assembly according to embodiments of the present technology may move relative to the distal end 160 of the ball bat. For example, the sprung-mass portion may move along the longitudinal axis x (see FIGS. 1 and 2B), transverse to the longitudinal axis x (such as perpendicular to the longitudinal axis x along the radial axis y, see FIGS. 1 and 2B), along a direction that includes components of motion along the longitudinal axis and transverse to the longitudinal axis, or along other directions relative to the distal end 160, such as general side-to-side movement relative to the distal end 160 (or relative to a base portion if a base portion is implemented). In some embodiments, the sprung-mass portion may be generally constrained along the longitudinal axis x (for example, to minimize movement of the sprung-mass portion along the longitudinal axis x) but allowed to move transversely to the longitudinal axis x, such as along the radial axis y.

For general context, the impulse force from a bat-ball collision may be in the range of thousands of pounds for approximately one or two milliseconds. The force of the collision with the ball causes the bat to change speed during the batter's swing as the ball compresses and changes direction. For example, the bat may change speed for a short period of time, such as 0.0007 seconds, by a measure of approximately 300 g (g-force), or by other quantities (which may be large). When the product of the mass of the sprung-mass portion of the end-cap assembly and the change in speed of the bat is greater than the spring force suspending the sprung-mass portion (provided by, for example, one or more flexible members, such as the flexible member 220), the sprung-mass portion of the end-cap assembly will move relative to the distal end 160. The motion of the sprung-mass portion will lag behind the motion of the ball bat (or the sprung-mass portion may stay generally stationary relative to the ball bat) until the product of the mass of the sprung-mass portion of the end-cap assembly and the change in speed of the bat is less than or equal to the spring force suspending the sprung-mass portion. The sprung-mass portion will oscillate relative to the bat depending on the characteristics of the material suspending the sprung-mass portion, which will dissipate some of the vibrational energy (for example, in the form of heat) from the impact, until the sprung-mass portion returns to its original resting position.

In other words, the sprung-mass portion moves relative to the bat to dampen shock and vibration from the impact between the bat and the ball.

Figure 2C:
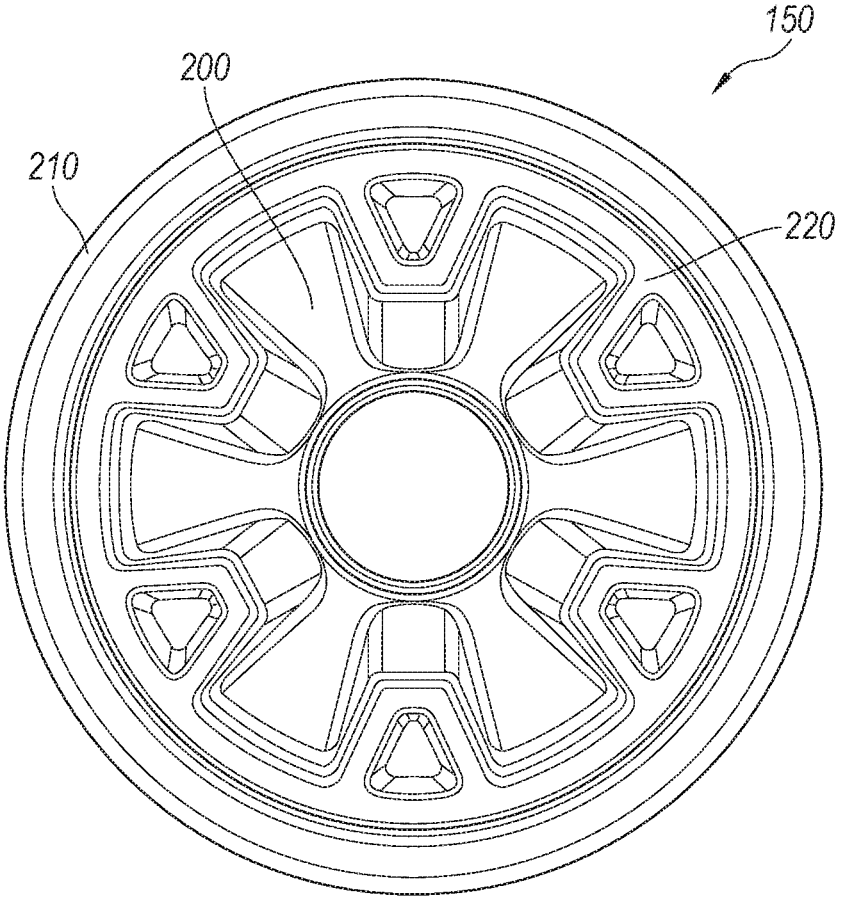
FIG. 2C illustrates a top view of the end-cap assembly shown in FIGS. 2A and 2B.

FIG. 2C illustrates a top view of the end-cap assembly 150 shown in FIGS. 2A and 2B. With reference to FIGS. 2A-2C, in some embodiments, the flexible member 220 may be formed by overmolding an elastomeric material onto the sprung-mass portion 200 and the base portion 210, thereby connecting the sprung-mass portion 200 to the base portion 210 via the flexible member 220. In some embodiments, the flexible member 220 may have a Shore hardness rating of approximately 70A or less (such as Shore 45A), or the flexible member 220 may have other hardness ratings, depending on, for example, the mass of the sprung-mass portion 200 and the characteristics of vibration sought to be reduced. For example, the flexible member 220 may be harder, such as approximately Shore 60D.

Figure 2D:
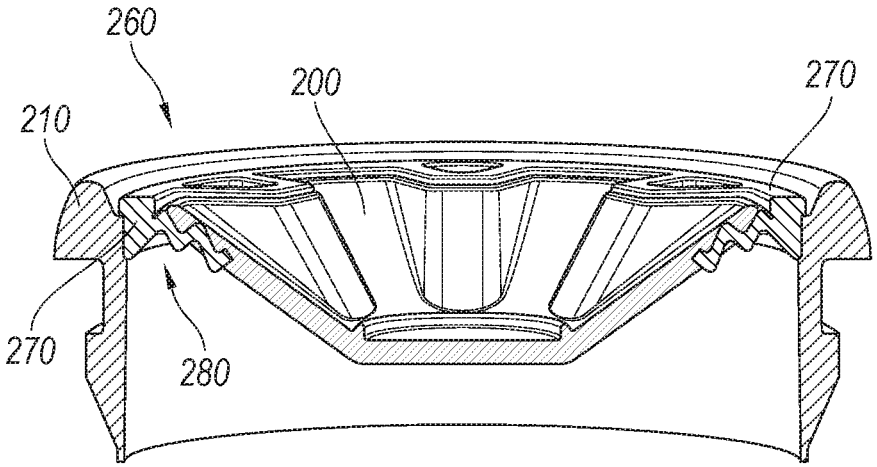
FIG. 2D illustrates a perspective cross-sectional view of an end-cap assembly configured in accordance with an embodiment of the present technology.

FIG. 2D illustrates a perspective cross-sectional view of an end-cap assembly 260 configured in accordance with another embodiment of the present technology. The end-cap assembly 260 may be generally similar to the end-cap assembly 150 illustrated in FIGS. 2A-2C, but the flexible member 270 may include a bellows shape 280 to further reduce stress and stiffness at the junction between the sprung-mass portion 200 and the base portion 210. The junction between the sprung-mass portion 200 and the base portion 210, including the flexible member 270, may take other forms or shapes suitable for facilitating relative movement between the sprung-mass portion 200 and the base portion 210.

End-cap assemblies configured in accordance with embodiments of the present technology (including assemblies described herein) may be formed as unitized structures in which the sprung-mass portion (such as the sprung-mass portion 200, or other sprung-mass portions), the base portion (such as the base portion 210, or other base portions, if a base portion is implemented), and the flexible member (such as the flexible member 220 or the flexible member 270, or other flexible members) are integrally formed. In some embodiments, end-cap assemblies may be formed from separate components brought together. Additional end-cap assemblies configured in accordance with embodiments of the present technology are disclosed herein, however, the present technology generally contemplates any end-cap assembly in which a sprung mass is suspended relative to (such as in or on) a distal end of a ball bat by one or more flexible members that facilitate movement of the sprung mass relative to the distal end of the bat.

End-cap assemblies configured in accordance with embodiments of the present technology may be formed such that the mass of the sprung-mass portion (such as the sprung-mass portion 200) is at least 5 percent of the overall mass of the end-cap assembly or up to 99 percent (such as 95 percent or more) of the overall mass of the end-cap assembly, or other percentages of the overall mass of the end-cap assembly. In some embodiments, for example, end-cap assemblies may weigh approximately 0.8 ounces (26.7 grams), while the sprung-mass portion may weigh between 0.04 ounces and 0.79 ounces. In other embodiments, end-cap assemblies may weigh other amounts, and the sprung-mass portions may weigh other amounts.

Figure 3A:
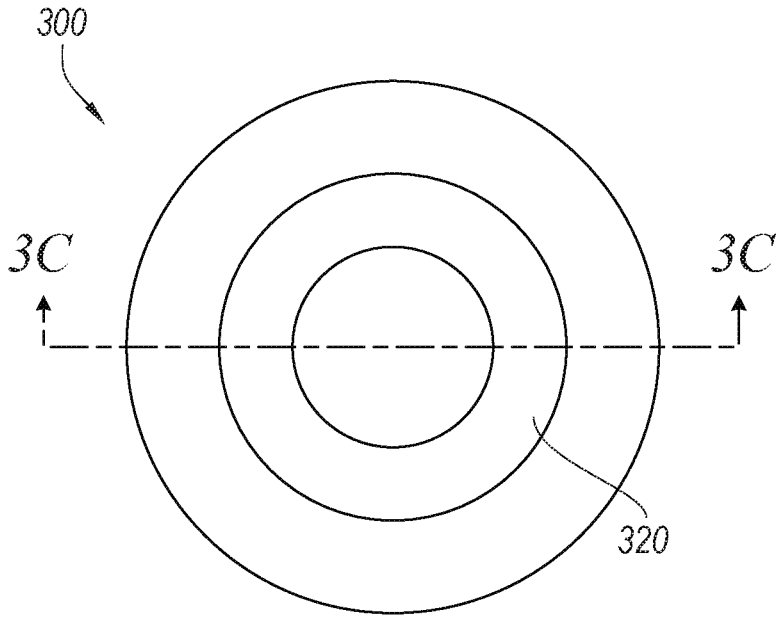
FIGS. 3A, 3B, and 3C illustrate a top view, a bottom view, and a side cross-sectional view, respectively, of an end-cap assembly configured in accordance with an embodiment of the present technology.
Figure 3B:
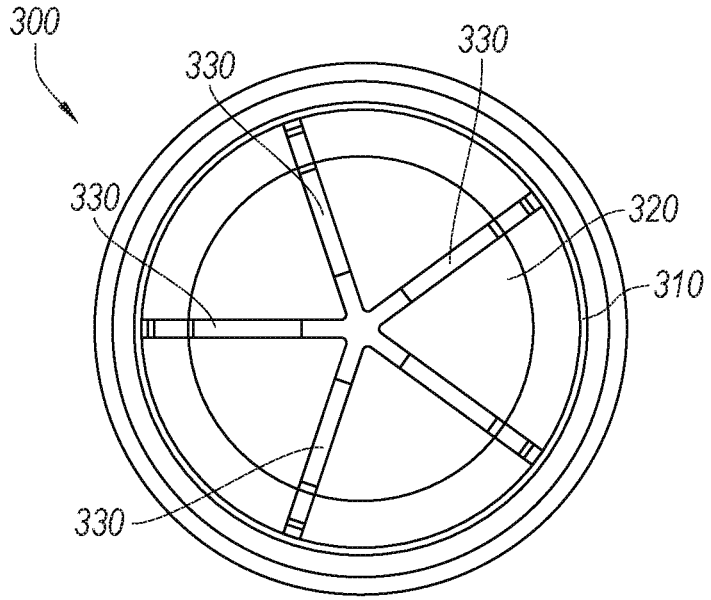
Figure 3C:
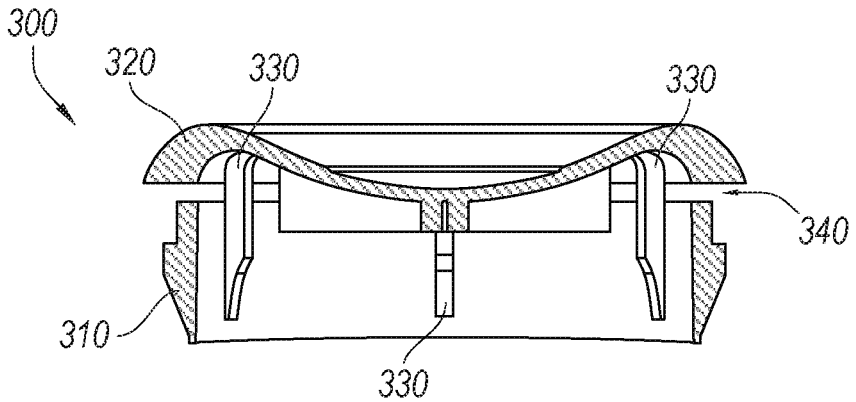
Figure 4A:
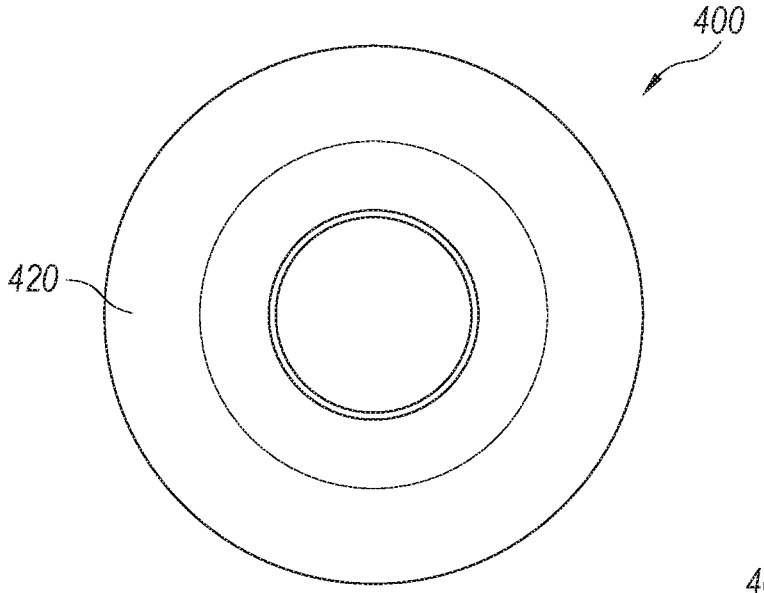
FIGS. 4A-4E illustrate a top view, a side view, a bottom view, a bottom perspective view, and a side cross-sectional view, respectively, of an end-cap assembly configured in accordance with an embodiment of the present technology.
Figure 4B:
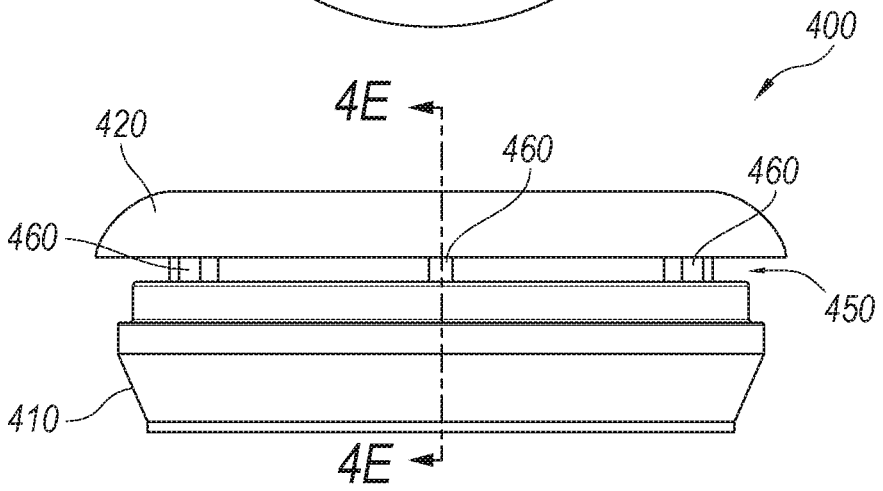
Figure 4C:
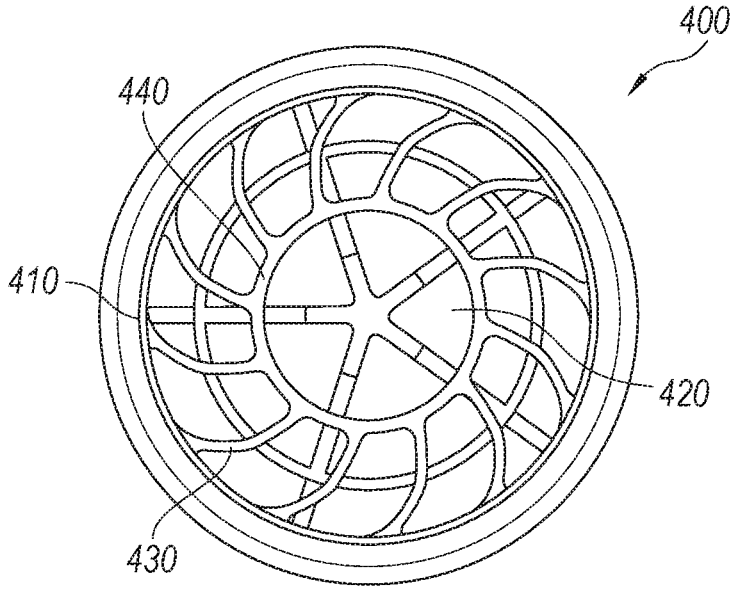
Figure 4D:
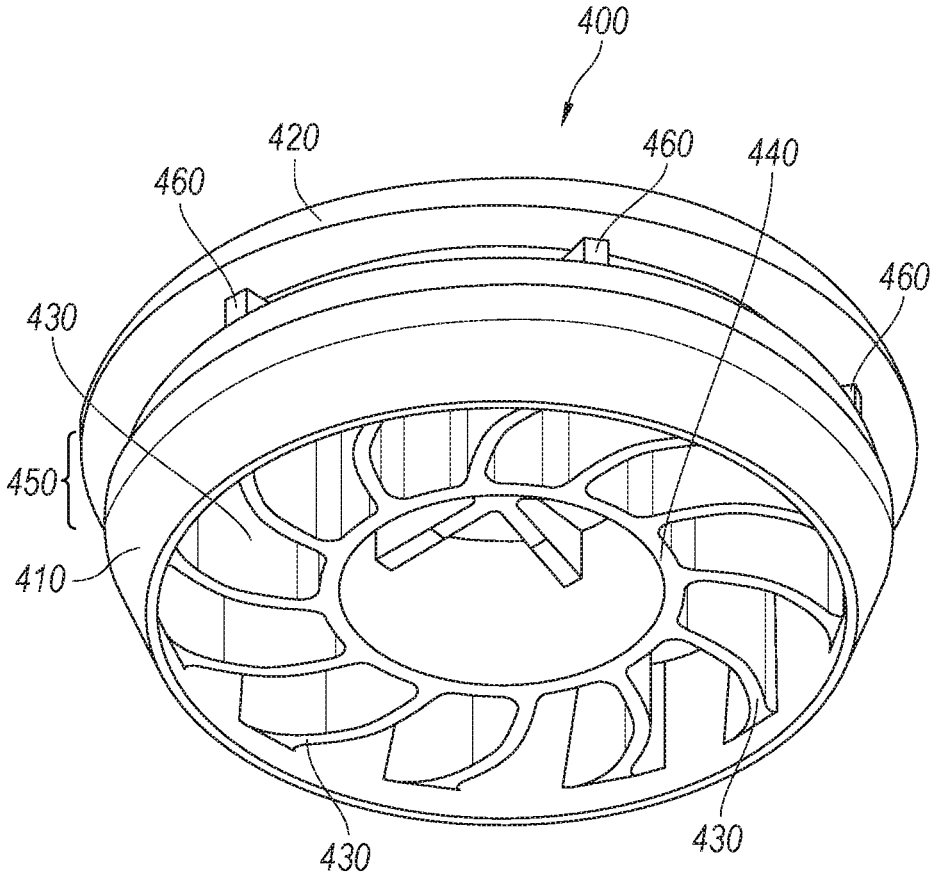
Figure 4E:
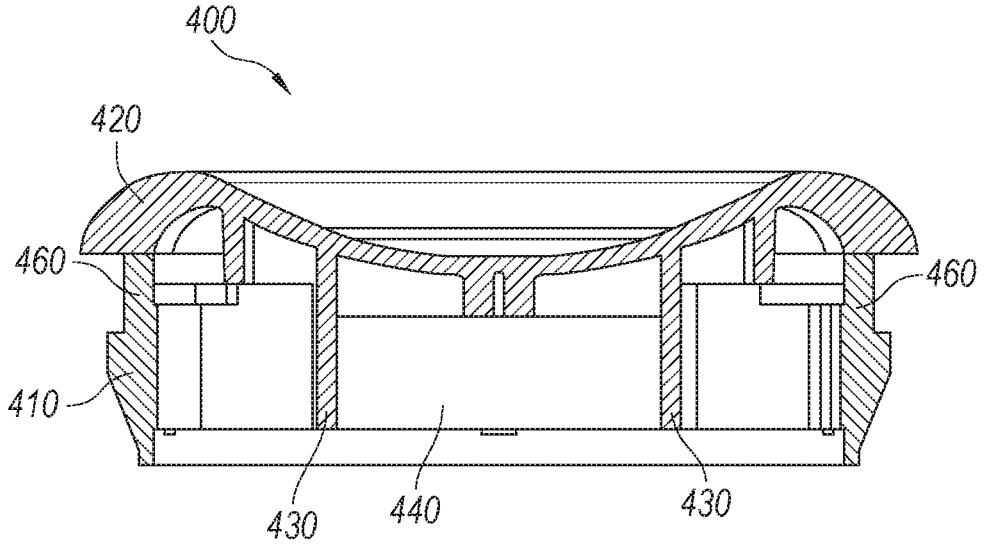

FIGS. 3A, 3B, and 3C illustrate a top view, a bottom view, and a side cross-sectional view, respectively, of an end-cap assembly 300 configured in accordance with another embodiment of the present technology. A base portion 310 may be configured to be mounted or otherwise restrained in or on the distal end 160 of a bat in a manner similar to the base portion 210 described above with regard to FIGS. 2A-2D. The base portion 310 supports a sprung-mass portion 320 that is suspended from the base portion 310 with one or more flexible members 330. The flexible members 330 may be in the form of ribs extending radially inwardly from the base portion 310 and—in some embodiments—longitudinally (along the bat's x-axis) between the base portion 310 and the sprung-mass portion 320. A gap 340 is provided between the base portion 310 and the sprung-mass portion 320, such that the base portion 310 and the sprung-mass portion 320 are spaced apart from each other along the longitudinal axis of the bat (which is equivalent to the longitudinal axis of the end-cap assembly) and connected to each other only by the flexible members 330. Accordingly, the sprung-mass portion 320 is generally isolated from the base portion 310 so that the sprung-mass portion 320 can move relative to the base portion 310 and the remainder of the ball bat. The sprung-mass portion 320 may move in a similar manner as the sprung-mass portion 200 described above for FIGS. 2A-2D to reduce vibration.

In some embodiments, the flexible members 330 or the sprung-mass portion 320 may be formed with a material having a hardness rating that is less than a hardness rating of a material forming the base portion 310. In some embodiments, the flexible members 330 may be soft and flexible enough to allow the sprung-mass portion 320 to compress toward the base portion 310 during installation of the end-cap assembly 300 (end-cap assemblies may be pressed into the distal end of the bat). Accordingly, in some embodiments, a tool or stiffening element may be positioned in or near the gap 340 to prevent damage to the flexible members 330 during installation.

FIGS. 4A-4E illustrate a top view, a side view, a bottom view, a bottom perspective view, and a side cross-sectional view, respectively, of an end-cap assembly 400 configured in accordance with another embodiment of the present technology. A base portion 410 may be configured to be mounted or otherwise restrained in or on the distal end 160 of a bat in a manner similar to the base portions described above. The base portion 410 supports a sprung-mass portion 420 that is flexibly suspended relative to the base portion 410 with one or more flexible members 430.

The sprung-mass portion 420 may include a hub 440 extending toward the knob of the ball bat and positioned concentrically within the base portion 410. The flexible members 430 may be in the form of curved ribs (such as serpentine ribs) that curve inwardly from the base portion 410 to the hub 440. The flexible members 430 allow the sprung-mass portion 420 to move relative to other components of the end-cap assembly or the distal end (e.g., transverse to the bat's longitudinal x-axis, such as perpendicular to the x-axis, along the radial y-axis, or other motion). In some embodiments, the flexible members 430 may be sufficiently stiff to limit axial movement along the bat's longitudinal axis x.

In some embodiments, a gap 450 may be located between the base portion 410 and the sprung-mass portion 420, such that the base portion 410 and the sprung-mass portion 420 are spaced apart from each other along the longitudinal axis x of the bat and connected to each other only by the flexible members 430. In some embodiments, the gap 450 may be minimal to limit movement of the sprung-mass portion 420 along the longitudinal x-axis of the bat (while still allowing movement transverse to the longitudinal x-axis, such as radial movement along the y-axis or other side-to-side movement), which in turn may help prevent overstressing the flexible members 430 during installation of the end-cap assembly 400 into the distal end 160 of the bat. In some embodiments, one or more optional axial support nubs 460 positioned on the base portion 410 and extending along the longitudinal x-axis of the bat toward the sprung-mass portion 420 may partially fill portions of the gap 450 to further limit movement of the sprung-mass portion 420 along the longitudinal x-axis. In some embodiments, similar nubs 460 may be implemented in the gap 340 described above with regard to FIGS. 3A-3C.

Figure 5A:
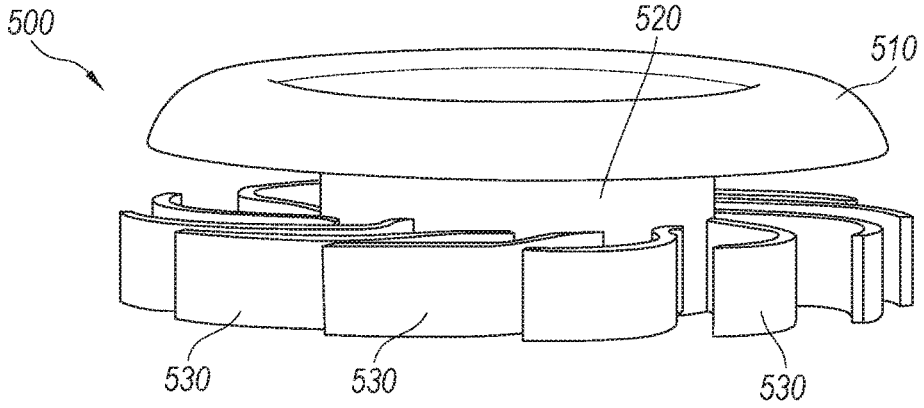
FIGS. 5A-5C illustrate a side perspective view, a bottom perspective view, and a side cross-sectional view, respectively, of an end-cap assembly configured in accordance with an embodiment of the present technology.
Figure 5B:
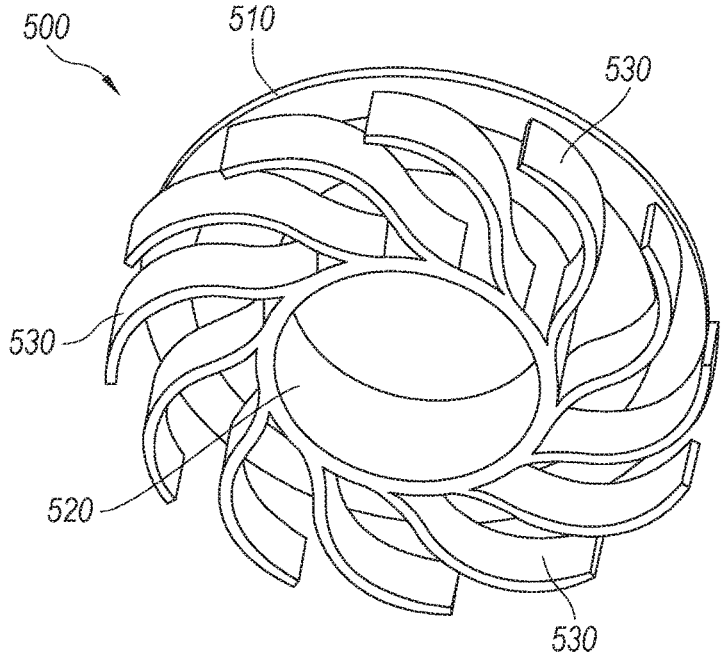
Figure 5C:
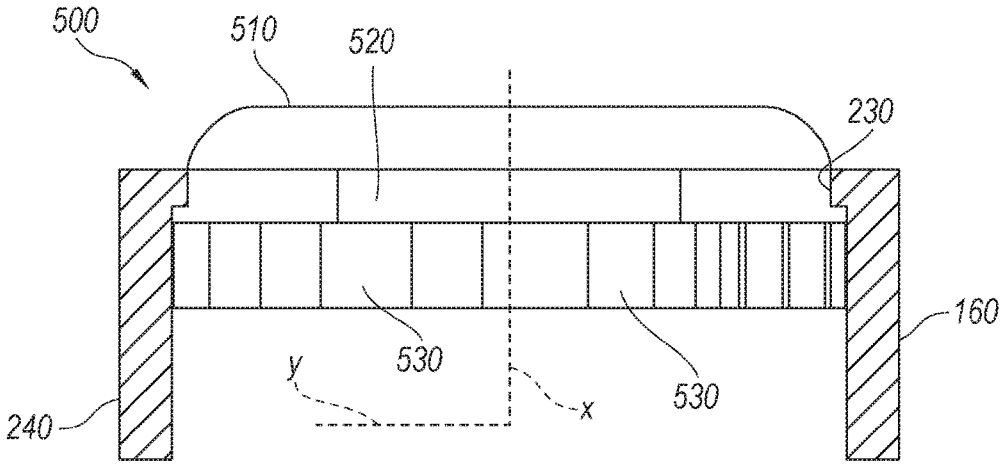

FIGS. 5A-5C illustrate a side perspective view, a bottom perspective view, and a side cross-sectional view, respectively, of an end-cap assembly 500 configured in accordance with another embodiment of the present technology. A sprung-mass portion 510 may include a hub 520 (which may be similar to the hub 440 described above with regard to FIGS. 4A-4E) extending toward the knob end of a bat. One or more flexible members 530 (such as a plurality of flexible members 530) may extend outwardly from the hub 520. The flexible members 530 may include curved ribs (such as serpentine ribs) extending from the hub 520 as shown in FIGS. 5A-5C, or they may extend from the hub 520 in other patterns suitable for providing flexible support between the hub 520 and the distal end 160 of the ball bat (see FIG. 5C). The flexible members 530 may hold the end-cap assembly 500 in the distal end 160 of the bat by extending underneath, and wider than, an opening created by the lip 230 of the wall 240 of the bat. The flexible members 530 enable movement of the sprung-mass portion 510 relative to the distal end 160, for example, movement transverse (such as perpendicular) to the longitudinal x-axis of the bat (or other movement), to provide vibration damping to the bat in a manner similar to other sprung-mass portions described herein. In some embodiments, the flexible members 530 may be bonded, adhered, mechanically fastened, or otherwise attached to the bat, with or without the implementation of a lip or groove in the ball bat. Accordingly, embodiments of the present technology include end-cap assemblies that do not require a base portion. In some embodiments, the sprung mass may constitute nearly the entire mass of the end-cap assembly 500.

FIGS. 6A-6D illustrate a top view, a side view, a side cross-sectional view, and an exploded side cross-sectional view, respectively, of an end-cap assembly 600 configured in accordance with another embodiment of the present technology, in which the assembly includes separate pieces assembled together. A base portion 610 may be configured to be mounted or otherwise restrained in or on the distal end 160 of a bat in a manner similar to the base portions described above. A sprung-mass portion 620 may include a connecting portion 630 positioned to extend concentrically into the base portion 610. A retention washer 640 may restrain (such as lock) the connecting portion 630 of the sprung-mass portion 620 to a corresponding connecting portion 650 of the base portion 610 to hold the sprung-mass portion 620 in the base portion 610 while allowing movement of the sprung-mass portion 620 relative to the base portion 610 (in a manner similar to other sprung-mass portions described herein). The connecting portion 630 may be cylindrical and it may include one or more beveled edges or lips for engaging the retention washer 640.

Figure 6A:
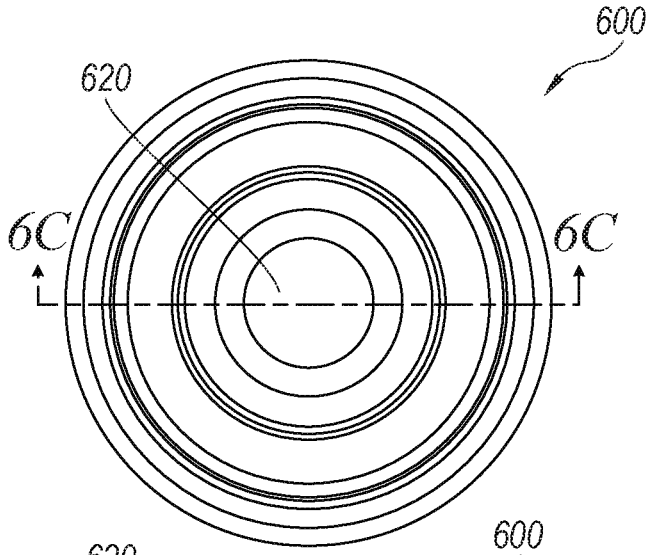
FIGS. 6A-6D illustrate a top view, a side view, a side cross-sectional view, and an exploded side cross-sectional view, respectively, of an end-cap assembly configured in accordance with an embodiment of the present technology.
Figure 6B:
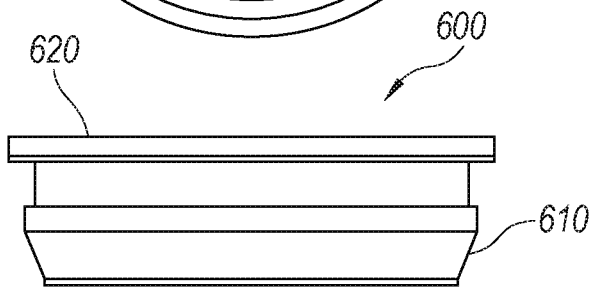
Figure 6C:
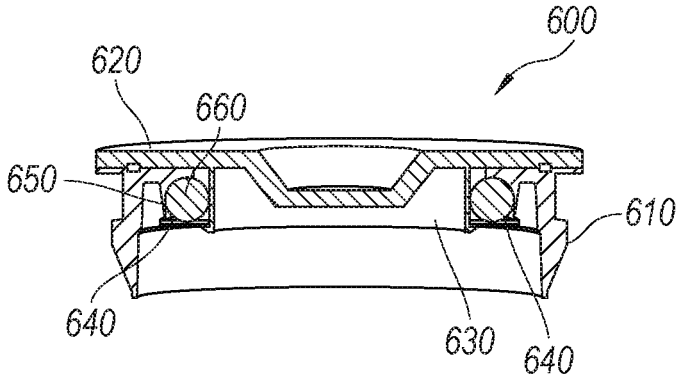
Figure 6D:
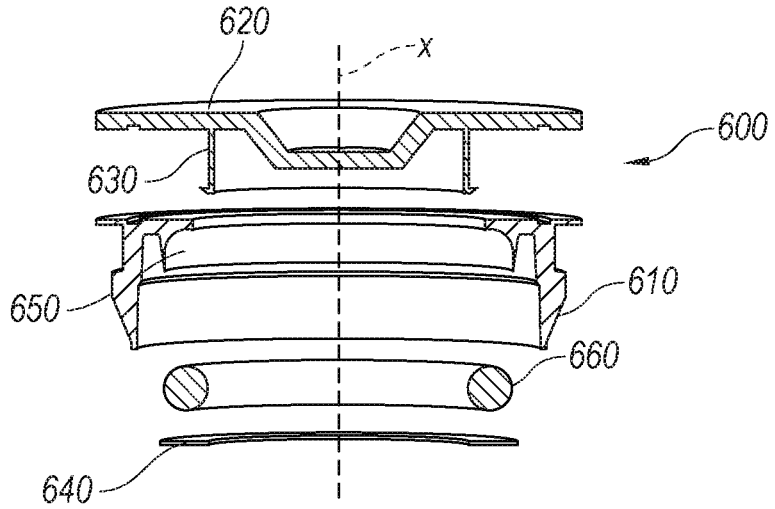

One or more flexible members, such as a flexible member 660, may be positioned between the connecting portion 630 of the sprung-mass portion 620 and the connecting portion 650 of the base portion 610 to enable dampened movement between the sprung-mass portion 620 and the base portion 610. The one or more flexible members may also provide a force or forces that tend to bias the sprung-mass portion 620 to be centered and concentric with the base portion 610. For example, the flexible member 660 may include an O-ring (made of foam or another suitable elastomeric material) as shown in FIGS. 6C and 6D or, in other embodiments, the flexible member 660 may include a J-spring, one or more serpentine ribs, or another element suitable for providing flexibility between the sprung-mass portion 620 and the base portion 610. In some embodiments, a J-spring may include a molded or stamped ring made of a resilient material (such as polyethylene, polypropylene, TPU, or a metallic spring material such as spring steel, beryllium copper, or another material) with a J-shaped cross section (for example, resembling a curled washer) suitable for providing the centering force provided by the one or more flexible members 660.

Figure 7A:
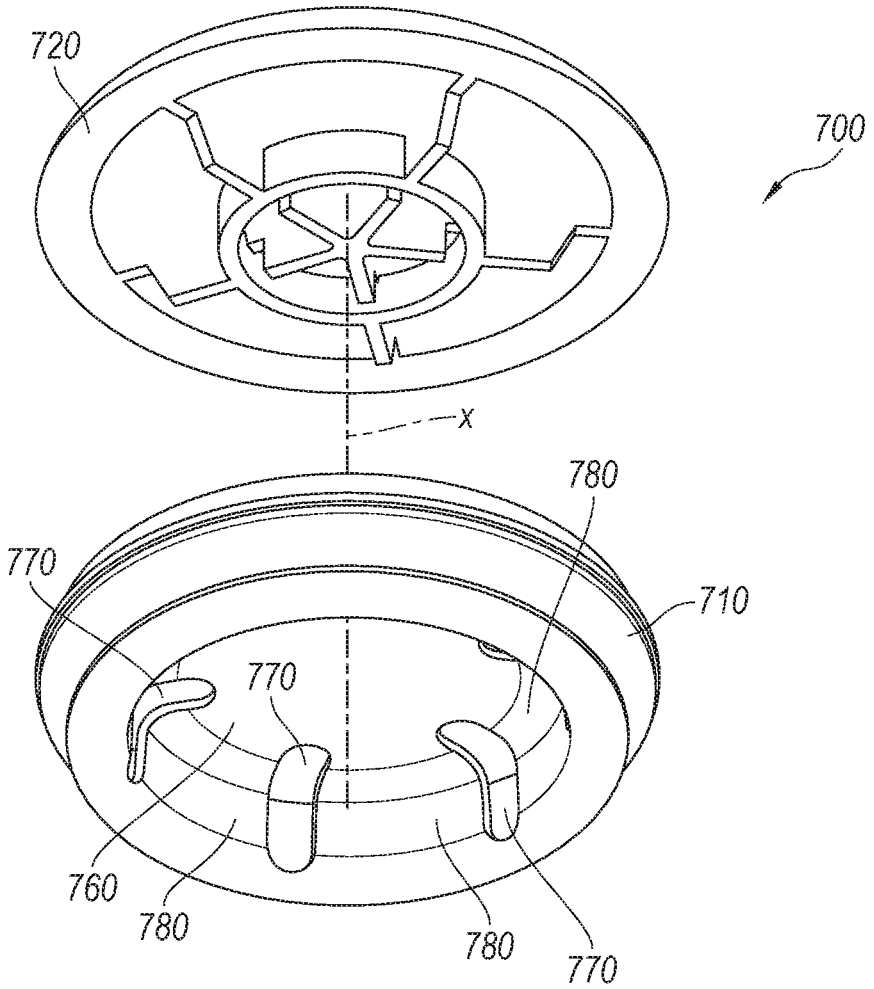
FIGS. 7A, 7B, and 7C illustrate a perspective exploded view, a perspective cross-sectional assembled view, and a schematic partially-assembled view, respectively, of an end-cap assembly configured in accordance with an embodiment of the present technology.
Figure 7B:
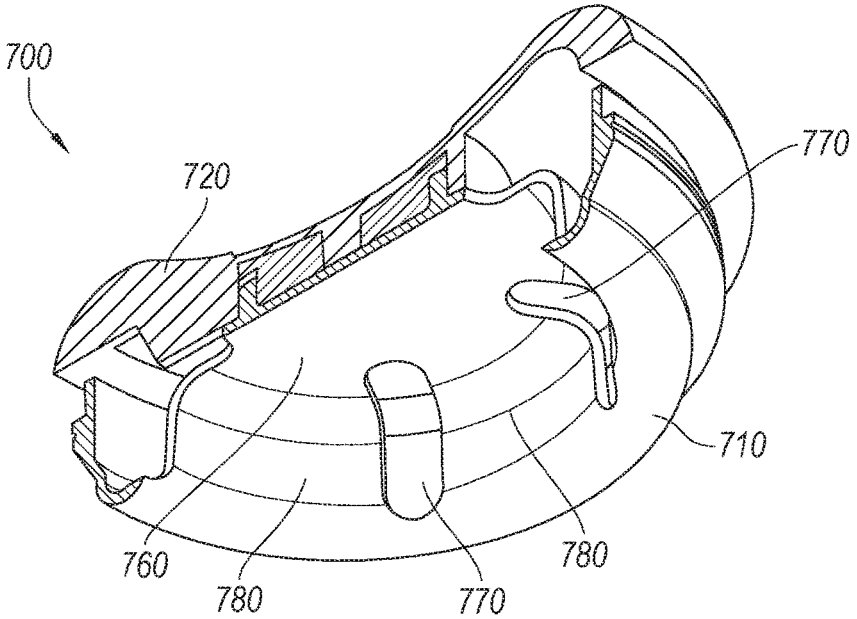
Figure 7C:
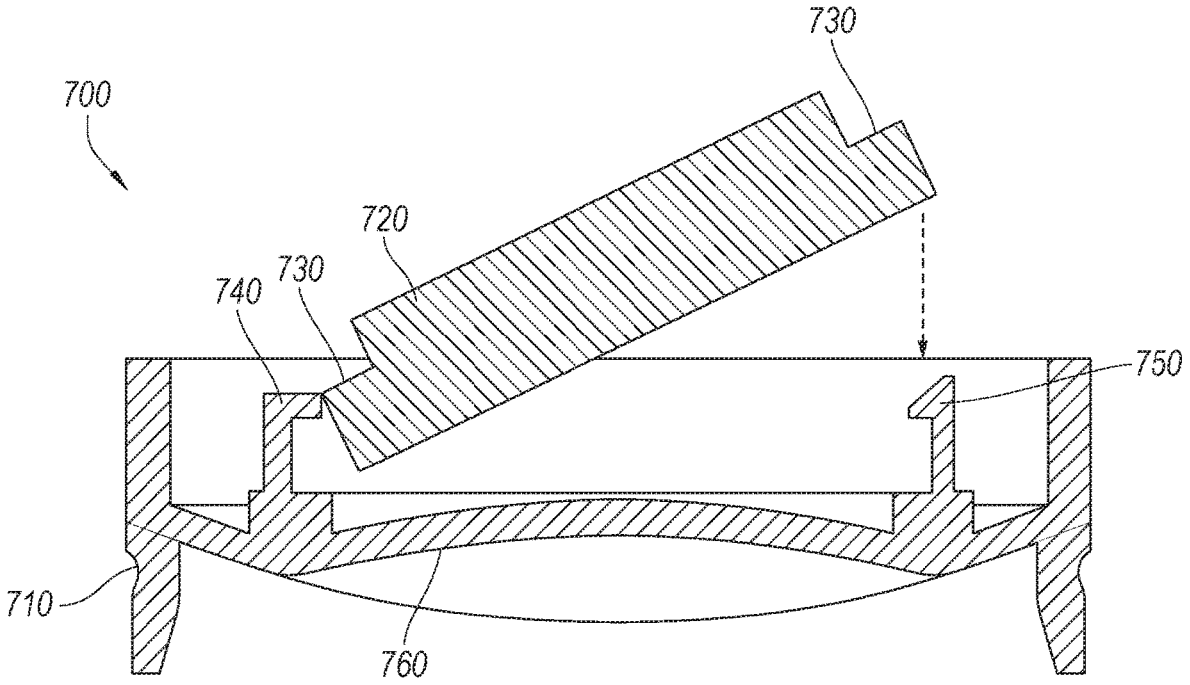

FIGS. 7A, 7B, and 7C illustrate a perspective exploded view, a perspective cross-sectional assembled view, and a schematic partially-assembled view, respectively, of an end-cap assembly 700 configured in accordance with another embodiment of the present technology, in which the assembly includes separate pieces assembled together. A base portion 710 may be configured to be mounted or otherwise restrained in or on the distal end 160 of a bat in a manner similar to the base portions described above.

A sprung-mass portion 720 is connected to the base portion 710. In some embodiments, the sprung-mass portion 720 may be connected to the base portion 710 by one or more hooks or other connectors or connections (such as one or more cantilever hooks, compressive hooks, bayonet-finger connections, traps, ball and socket joints, annular snap joints, heat staking, riveting, spin-welding, vibrational welding, interference fit, adhesive, or other suitable manners of attachment). In a specific example, as shown in FIG. 7C, the sprung-mass portion 720 (only a schematic view is shown) may have a flange portion 730, and the base portion 710 may have a locating feature 740 and a locking feature 750. The flange portion 730 may fit under the locating feature 740 and snap under the locking feature 750. Although several examples are provided, the sprung-mass portion 720 may be connected to the base portion 710 in any suitable manner.

With reference to FIGS. 7A and 7B, the base portion 710 includes a domed interior portion 760 that is configured to face a hollow interior of a ball bat. The domed interior portion 760 may include one or more cutouts 770 extending along the longitudinal axis x and around part of the curvature of the domed interior portion 760. The cutouts 770 form one or more flexible members 780 between the cutouts 770. Accordingly, the flexible members 780 between the cutouts 770 may be in the form of J-hooks that are integral with the base portion 710. The flexible members 780 function similarly to other flexible members described herein such that they allow the sprung-mass portion 720 to move relative to the remainder of the base portion 710 and the ball bat to dampen vibration.

As explained above, in some embodiments, the sprung mass may constitute nearly the entire mass (such as 95% or more) of the end-cap assembly. Other embodiments in which that may be achieved include an end cap molded from a flexible foam material and bonded to the bat frame, or a rigid end cap sized to leave a gap between the bat wall and the end cap, whereby the foam or elastomeric material is positioned in the gap to function as a flexible member.

End-cap assemblies configured in accordance with embodiments of the present technology may be formed as integral or unitary pieces, or as multiple pieces attached together. End-cap assemblies or components thereof configured in accordance with embodiments of the present technology may be formed with any suitable resilient, elastomeric, or flexible material, such as polyurethane, polyolefins, polyethylene (PE), polypropylene (PP), polymethylpentene (PMP), polybutene-1 (PB-1), polyolefin elastomers (POE), polyisobutylene (PIB), ethylene propylene rubber (EPR), ethylene propylene diene monomer rubber (EPDM rubber), thermoplastic elastomers (TPE), thermoplastic rubber (TPR), other rubbers, styrene-butadiene rubber (SBR), natural rubber (NR), isoprene (IR), neoprene (CR), nitrile (NBR), silicone, polybutylene terephthalate (PBT), acrylonitrile butadiene styrene (ABS), polyamide (PA), metal materials such as spring steel or other metals, or other relatively rigid materials or relatively soft materials suitable for providing resilience and mass. In some embodiments, materials used to make traditional ball bat end caps may be used. In some embodiments, materials with hardness ratings greater than Shore 60D may be used, although materials with any suitable hardness rating may be used.

Advantages of embodiments of the present technology include providing vibration damping without adding excess weight or requiring a special grip or glove. Many bats already implement standard end caps. Embodiments of the present technology implement vibration damping into end caps, such that embodiments of the present technology do not add significant complication or additional parts. In other words, the present technology uses mass similar to that which is otherwise traditionally fixed to the end of a bat as a movable sprung mass to function as a vibration damper.

End caps configured in accordance with embodiments of the present technology may also limit bat performance to help maintain compliance with league regulations (such as regulations associated with Bat-Ball Coefficient of Restitution or "BBCOR", Batted-Ball Speed or "BBS", or Bat Performance Factor or "BPF"). For example, the sprung mass may remain generally stationary during impact between the bat and the ball, or it may lag behind the rebound motion of the bat. The inventors observed that in some configurations, this may happen when the stiffness of the "spring" (for example, the flexible material carrying the sprung mass in a cap) has a natural frequency less than 1000 Hertz. In some embodiments, if the sprung mass of the end cap has a natural frequency greater than 1000 Hertz, only the portion of the energy moving out of phase for a one-millisecond impact (the time the ball is generally in contact with the bat) will act against propelling or rebounding the ball. For example, an end-cap assembly having a sprung mass with a natural frequency of 2000 Hertz may result in only half of the vibration cycles moving out of phase of the ball during the one-millisecond impact. In other words, the sprung mass delays and reduces vibration, and it may also limit performance to assist in meeting performance regulations.

The sprung mass may help limit bat performance in other ways. For example, during the short time the ball is in contact with the bat (which may be approximately one millisecond), the momentum of the sprung mass is not acting on the ball. This slight loss of momentum lowers the impact power of the bat, which results in a lower batted-ball speed. Accordingly, a batter using an end cap configured in accordance with some embodiments of the present technology may experience a small decrease in batted ball speed but will experience a corresponding reduction in bat vibration (particularly when the ball does not impact the sweet spot).

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, the mass of the sprung-mass portions, the flexibility of the flexible members (and their natural frequencies, which may be relatively high or low, or other frequencies), and other characteristics may be selected to tune the damping effect to a given bat or style of play. In some embodiments, the sprung-mass portions may include recesses or other regions positioned and configured to receive interchangeable weights to customize the amount of sprung mass. In some embodiments, one or more additional manners of attachment may be used to secure the end-cap assemblies or their component parts to the bat to resist removal of the end-cap assemblies or their component parts from the bat.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A ball bat, comprising:

a handle including a knob, a barrel attached to the handle along a longitudinal axis of the bat and having a distal end positioned opposite the knob, and an end-cap assembly, wherein the end-cap assembly comprises:

a base portion attached to the distal end of the barrel;

a sprung-mass portion, wherein the sprung-mass portion is spaced apart from the base portion along the longitudinal axis of the bat to form a gap between the sprung-mass portion and the base portion; and one or more flexible members connecting the sprung-mass portion to the base portion to suspend the sprung-mass portion relative to the base portion and to space apart the sprung-mass portion from the base portion along the longitudinal axis of the bat to form the gap; wherein the sprung-mass portion is movable relative to the base portion along a direction that is transverse to the longitudinal axis.

2. The ball bat of claim 1 wherein the sprung-mass portion and the base portion are connected to each other by only the one or more flexible members.

3. The ball bat of claim 1 wherein the one or more flexible members comprise a plurality of ribs extending radially inwardly from the base portion and longitudinally between the base portion and the sprung-mass portion.

4. The ball bat of claim 1 wherein the sprung-mass portion comprises a hub, and wherein the one or more flexible members comprises a plurality of serpentine ribs extending between the hub and the base portion.

5. The ball bat of claim 1 wherein the base portion comprises one or more axial support nubs positioned to at least partially fill the gap.

6. The ball bat of claim 1 wherein the base portion is integral with the one or more flexible members.

* * * * *